US009172146B2

(12) United States Patent
Ishikawa

(10) Patent No.: US 9,172,146 B2
(45) Date of Patent: Oct. 27, 2015

(54) ANTENNA APPARATUS

(71) Applicant: FUJITSU LIMITED, Kawasaki-shi, Kanagawa (JP)

(72) Inventor: Shohei Ishikawa, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 195 days.

(21) Appl. No.: 13/964,679

(22) Filed: Aug. 12, 2013

(65) Prior Publication Data

US 2014/0125534 A1 May 8, 2014

(30) Foreign Application Priority Data

Nov. 5, 2012 (JP) ..... 2012-243795

(51) Int. Cl.

| | |
|---|---|
| ***H01Q 1/00*** | (2006.01) |
| ***H01Q 21/24*** | (2006.01) |
| ***H01Q 9/26*** | (2006.01) |
| ***H01Q 13/10*** | (2006.01) |

(52) U.S. Cl.

CPC ..... *H01Q 21/245* (2013.01); *H01Q 9/26* (2013.01); *H01Q 13/106* (2013.01)

(58) Field of Classification Search

CPC ..... H01Q 1/00
USPC ..... 343/730, 702, 767, 860, 793
See application file for complete search history.

(56) References Cited

U.S. PATENT DOCUMENTS

| | | | | |
|---|---|---|---|---|
| 8,180,412 | B2 * | 5/2012 | Wong et al. | 455/575.1 |
| 8,489,162 | B1 * | 7/2013 | Dou et al. | 455/575.7 |
| 8,774,880 | B2 * | 7/2014 | Wong et al. | 455/575.7 |
| 2007/0176839 | A1 | 8/2007 | Kai et al. | |
| 2008/0238804 | A1 | 10/2008 | Suh et al. | |
| 2009/0251383 | A1 | 10/2009 | Tani et al. | |

(Continued)

FOREIGN PATENT DOCUMENTS

| | | |
|---|---|---|
| EP | 2109185 A1 | 10/2009 |
| JP | 2006-186880 | 7/2006 |

(Continued)

OTHER PUBLICATIONS

Woong Kang et al: "A Beam Reconfigurable Antenna Using MEMS Switches", Antennas and Propagation Society International Symposium. 2009. APSURSI '09, IEEE, Piscataway, NJ, USA, Jun. 1, 2009, pp. 1-4.

(Continued)

*Primary Examiner* — Huedung Mancuso
(74) *Attorney, Agent, or Firm* — Fujitsu Patent Center

(57) ABSTRACT

According to an embodiment, an antenna apparatus include a ground plate; a first element disposed along the ground plate; a second element disposed along the first element at an opposing side of the ground plate; a connecting part to connect first and second terminal parts of the first element with first and second terminal parts of the second element, respectively, or to connect the first and second terminal parts of the first element with the ground plate; a first power feeding portion to feed power at a midpoint of the first or second element in a longitudinal direction when the first and second elements are connected together by the connecting part; and a second power feeding portion to feed power to the first element or the ground plate when the first element and the ground plate are connected together by the connecting part.

8 Claims, 12 Drawing Sheets

(56) References Cited

U.S. PATENT DOCUMENTS

| | | | | |
|---|---|---|---|---|
| 2012/0218156 | A1* | 8/2012 | Mohammadian | 343/730 |
| 2013/0127672 | A1* | 5/2013 | Zhu et al. | 343/702 |

FOREIGN PATENT DOCUMENTS

| | | | |
|---|---|---|---|
| JP | 2007-208536 | | 8/2007 |
| JP | 2011-15034 | A | 1/2011 |

OTHER PUBLICATIONS

Extended European Search Report issued on Mar. 31, 2014 with the corresponding European Patent Application No. 13180096.3, 10 pages.

CNOA—Office Action mailed on Jun. 1, 2015 issued with respect to the corresponding Chinese Patent Application No. 201310389571.4, with English translation.

* cited by examiner

ANTENNA APPARATUS

CROSS-REFERENCE TO RELATED APPLICATIONS

This application is based upon and claims the benefit of priority of the prior Japanese Priority Application No. 2012-243795 filed on Nov. 5, 2012, the entire contents of which are hereby incorporated by reference.

FIELD

The disclosures herein relate to an antenna apparatus.

BACKGROUND

To improve radio signal quality, a technology has been developed that makes it possible to receive multiple radio waves having polarization planes different from each other by providing antennae for the respective polarization planes, and to prioritize a radio wave having higher strength to be used among the received radio waves. Such a technology is called polarization diversity.

An antenna that combines a dipole antenna and a slot antenna can be found, for example, in Patent Document 1.

This circular polarized antenna includes one antenna providing an antenna element extended in a predetermined direction, as well as another antenna that is configured as an aperture antenna to which a frame-shaped conductor is disposed.

RELATED-ART DOCUMENTS

Patent Documents

[Patent Document 1] Japanese Laid-open Patent Publication No. 2006/186880

Incidentally, with a conventional antenna apparatus such as a circular polarized antenna, it is difficult to make the antenna apparatus smaller because the one antenna and the other antenna are arranged in series in the longitudinal direction.

SUMMARY

According to an embodiment, an antenna apparatus includes: a ground plate; a first element disposed along an edge line of the ground plate; a second element disposed along the first element at an opposing side of the ground plate, the opposing side being determined with respect to a plane view; a connecting part to connect a first terminal part and a second terminal part of the first element with the first terminal part and the second terminal part of the second element, respectively, or to connect the first terminal part and the second terminal part of the first element with the ground plate; a first power feeding portion to feed power at a midpoint of the first element or the second element in a longitudinal direction when the first element and the second element are connected with each other by the connecting part; and a second power feeding portion to feed power to the first element or the ground plate when the first element and the ground plate are connected with each other by the connecting part.

The object and advantages of the embodiment will be realized and attained by means of the elements and combinations particularly pointed out in the claims. It is to be understood that both the foregoing general description and the following detailed description are exemplary and explanatory and are not restrictive of the invention as claimed.

DESCRIPTION OF EMBODIMENTS

In the following, antenna apparatuses will be described according to preferred embodiments of the disclosures. The preferred embodiments relate to, for example, an antenna apparatus used in a wireless sensor network that combines a folded dipole antenna and a slot antenna, which can selectively utilize multiple radio waves having polarization planes different from each other.

First Embodiment

Figure 1:
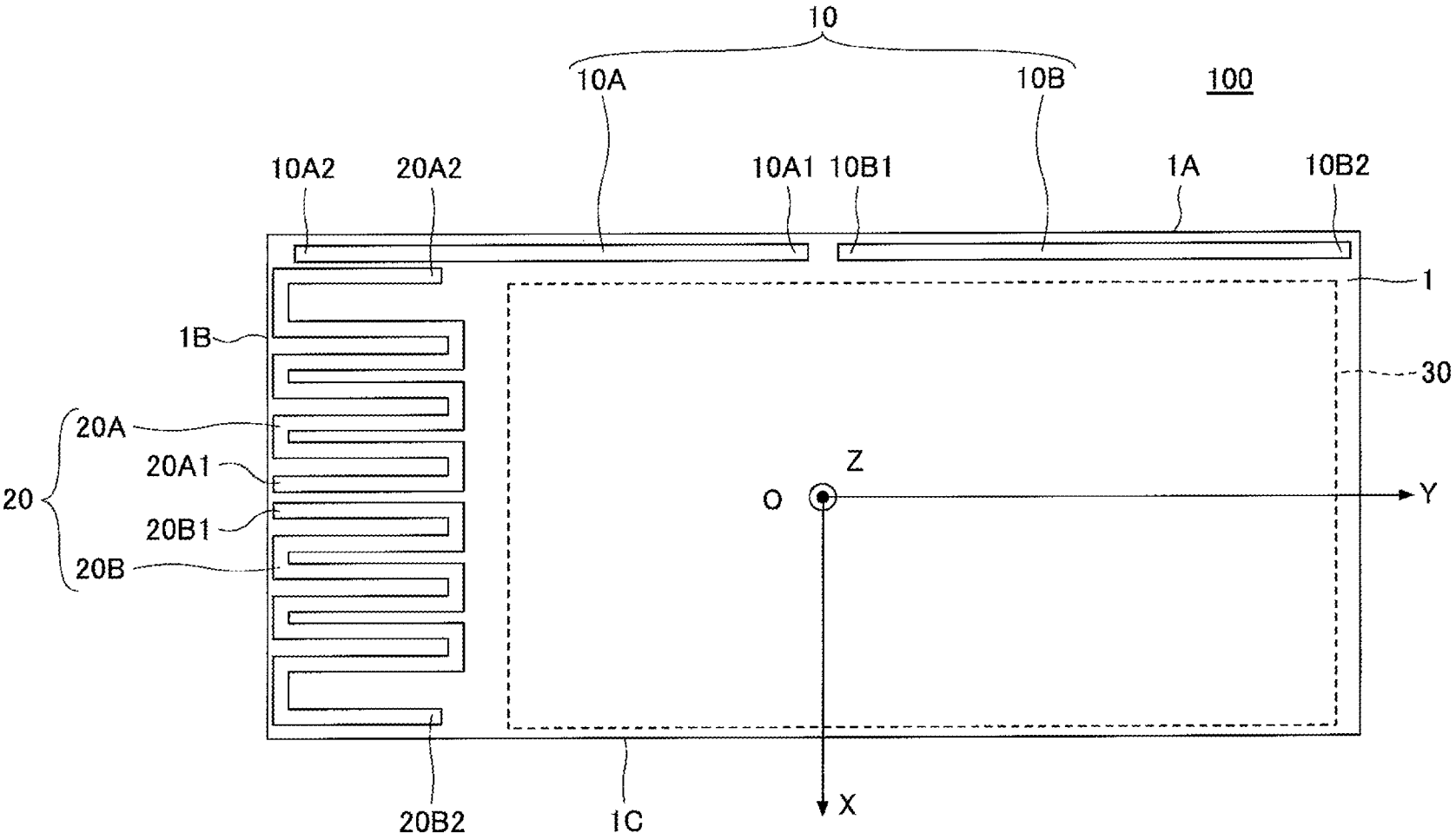
FIG. 1 is a schematic view illustrating an antenna apparatus 100 according to a first embodiment.

FIG. 1 is a schematic view illustrating an antenna apparatus 100 according to the first embodiment.

According to the first embodiment, the antenna apparatus 100 includes a circuit board 1, two antenna elements 10-20, and a ground element 30. Here, an X-Y-Z coordinate system is defined as an orthogonal coordinate system whose origin is set at the center of the surface (the illustrated side in FIG. 1) of the circuit board 1. The X-axis extends in the downward direction from the center O in FIG. 1, the Y-axis extends in the right direction from the center O, and the Z-axis extends vertically upward from the center O.

The antenna elements 10-20 form a diversity antenna. According to the first embodiment, the antenna apparatus 100 is a device for communications using a diversity antenna that may serve a wireless sensor network, for example, using an area where communication can be done with the antenna elements 10-20 to receive information to be detected by a node (wireless terminal).

The circuit board 1 has a rectangular plate-shaped form in plane view, and its lateral direction is along the X-axis direction and its longitudinal direction is along the Y-axis direction. The thickness of the circuit board 1 is the length in the Z-axis direction. The circuit board 1 is, for example, an insulated circuit board compliant with FR-4 (Flame Retardant type 4) standards.

The antenna elements 10-20 and ground element 30 are formed on the surface of the circuit board 1. The antenna elements 10-20 and ground element 30 are formed, for example, with generating patterns by applying etching or the like to copper foil formed on the surface of the circuit board 1.

The antenna element 10 is a dipole antenna that has elements 10A-10B, and fed with power at one terminal 10A1 of the element 10A and one terminal 10B1 of the element 10B. Power is fed, for example, using a balun supplying high-frequency signals having opposite phases to each other at the elements 10A-10B from a coaxial cable.

The elements 10A-10B are line-shaped conductors with the same length, disposed in the vicinity of an edge line 1A that extends in parallel with the Y-axis, and located in the X-axis negative direction of the circuit board 1.

Namely, the element 10A extends from the one terminal 10A1 to another terminal 10A2 in the Y-axis negative direction. The element 10B extends from the one terminal 10B1 to another terminal 10B2 in the Y-axis positive direction. The length between the other terminal 10A2 and the other terminal 10B2 is set to half of the wavelength (λ) of the operational frequency of the antenna element 10.

The polarization direction of the above antenna element 10 is in the Y-axis direction. Wireless communication using the antenna element 10 is executed while wireless communication using the antenna element 20 is not executed. Namely, power is fed to the antenna element 10 while power is not fed to the antenna element 20.

The antenna element 20 is a dipole antenna folded in a meandering shape including elements 20A-20B. The antenna element 20 is fed with power at one terminal 20A1 of the element 20A and one terminal 20B1 of the element 20B. Power is fed, for example, using a balun supplying high-frequency signals having opposite phases to each other at the elements element 20A-20B from a coaxial cable.

The elements element 20A-20B are meander-shaped conductors with the same length, formed in the vicinity of and along an edge line 1B that is parallel to the X-axis, and located in the Y-axis negative direction of the circuit board 1.

The one terminal 20A1 of the element 20A is positioned in the vicinity of the midpoint of the edge line 1B. Another terminal 20A2 of the element 20A is positioned in the vicinity of the element 10A, and the final segment of the folded meander-shaped form from the one terminal 20A1 to the other terminal 20A2 is formed in the vicinity of and parallel to the element 10A.

The one terminal 20B1 of the element 20B is positioned adjacent to the one terminal 20A1 of the element 20A in the vicinity of the midpoint of the edge line 1B. The element 20B is folded in a meander shape from the one terminal 20B1 to another terminal 20B2, and has a nearly line-symmetric form with the element 20A across the Y-axis.

The final segment of the element 20B that is folded in the meandering-shaped form from the one terminal 20B1 to the other terminal 20B2 is formed in the vicinity of and along the edge line 1C of the circuit board 1. The edge line 1C is an edge line of the circuit board 1 located on the opposite side of the edge line 1A across the X-axis.

The polarization direction of the above antenna element 20 is in the X-axis direction, which is different by 90 degrees from the polarization direction of the antenna element 10 (Y-axis direction). The reason for having 90-degree difference between the polarization directions of the antenna elements 10-20 is to reduce a correlation between the antenna elements 10-20 so that a diversity effect by the antenna elements 10-20 is improved.

Wireless communication using the antenna element 20 is executed while wireless communication using the antenna element 10 is not executed. Namely, power is fed to the antenna element 20 while power is not fed to the antenna element 10.

The ground element 30 is formed on an area of the surface of the circuit board 1 where the antenna elements 10-20 are not formed. The ground element 30 functions as a ground plate for the antenna elements 10-20, and is also used as an area to mount various electronic parts, for example, a CPU (Central Processing Unit) chip, a memory chip, and the like. The ground element 30 occupies most of the surface of the circuit board 1.

The reason the ground element 30 is formed occupying most of the surface of the circuit board 1 and the antenna elements 10-20 are formed in the remaining area is to make the antenna apparatus 100 smaller.

For example, if the antenna apparatus 100 according to the first embodiment is used for configuring a wireless sensor network, the antenna apparatus 100 is required to be made small to make a receiver device that includes the antenna apparatus 100 smaller.

To make it a suitable device for such usage, the antenna apparatus 100 is made small according to the first embodiment. Also, to improve transmitting/receiving sensitivity for wireless communications with nodes (wireless terminals) included in such a wireless sensor network, the antenna apparatus 100 adopts a diversity method realized by the antenna elements 10-20.

Here, with reference to FIG. 2, directivity patterns of the antenna elements 10-20 will be described.

Figure 2A:
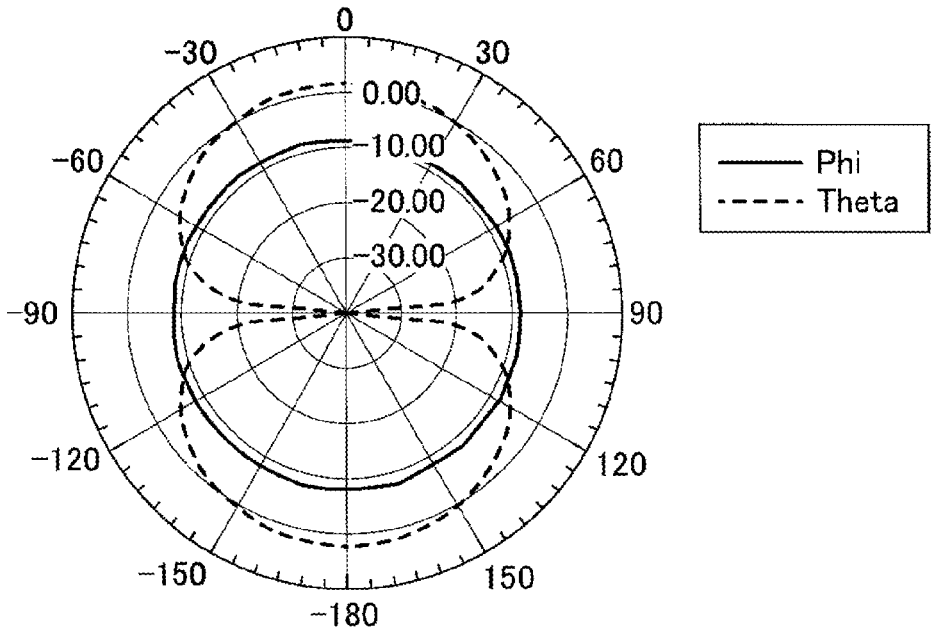
FIGS. 2A-2B are schematic views illustrating directivity patterns of the antenna apparatus 100 according to the first embodiment.
Figure 2B:
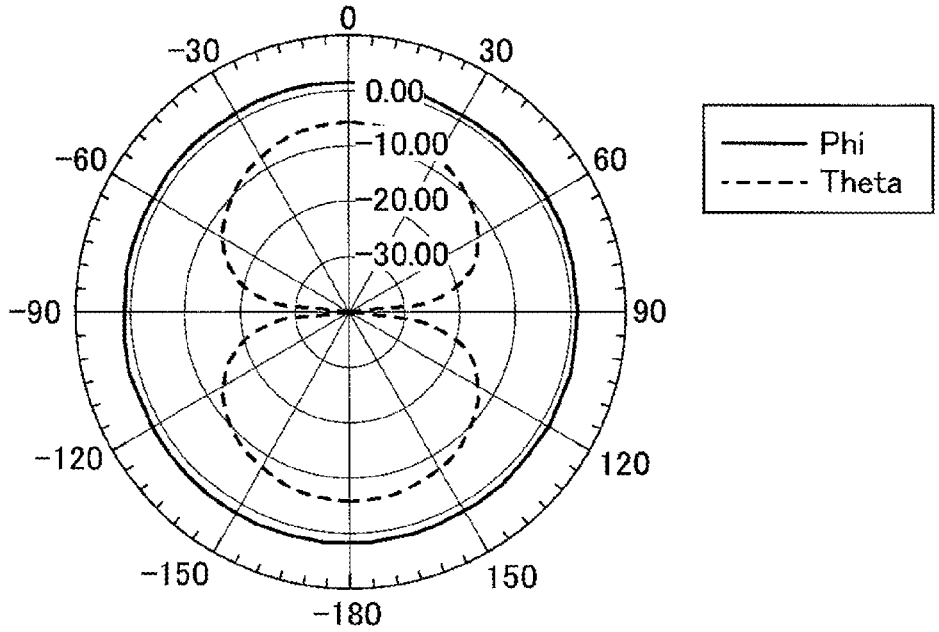

FIGS. 2A-2B are schematic views illustrating directivity patterns of the antenna apparatus 100 according to the first embodiment. FIG. 2A illustrates a directivity pattern on the Y-Z plane when feeding power to the antenna element 10, and FIG. 2B illustrates a directivity pattern on the Y-Z plane when feeding power to the antenna element 20.

In FIGS. 2A-2B, results of an electromagnetic field simulation are illustrated that are obtained with setting the operational frequency of the antenna apparatus 100 to 1 GHz. In FIGS. 2A-2B, gain in ϕ component is designated with a solid line, and gain in θ component is illustrated with dashed lines.

As illustrated in FIG. 2A, in the directivity pattern on the Y-Z plane when power is fed to the antenna element 10, ϕ component designated with the solid line can be confirmed in addition to θ component designated with the dashed line.

When power is fed to the antenna element 10, the antenna element 20 is not fed with power; hence, ideally, no radiation is generated from the antenna element 20, and only θ component is supposed to be observed.

However, ϕ component is confirmed with the solid line as illustrated in FIG. 2A, which indicates that the antenna element 20 generates radiation when power is fed to the antenna element 10 in the antenna apparatus 100.

Also, as illustrated in FIG. 2B, in the directivity pattern on the Y-Z plane when power is fed to the antenna element 20, θ component designated with the dashed lines can be confirmed in addition to ϕ component designated with the solid line.

When power is fed to the antenna element 20, the antenna element 10 is not fed with power; hence, ideally, no radiation is generated from the antenna element 10, and only ϕ component is supposed to be observed.

However, θ component is confirmed with the dashed line as illustrated in FIG. 2B, which indicates that the antenna element 10 generates radiation when power is fed to the antenna element 20 in the antenna apparatus 100.

As above, in the antenna apparatus 100 according to the first embodiment, the correlation between the antenna elements 10-20 is not sufficiently low, which suggests that mutual coupling between the antenna elements 10-20 is generated.

Figure 3:
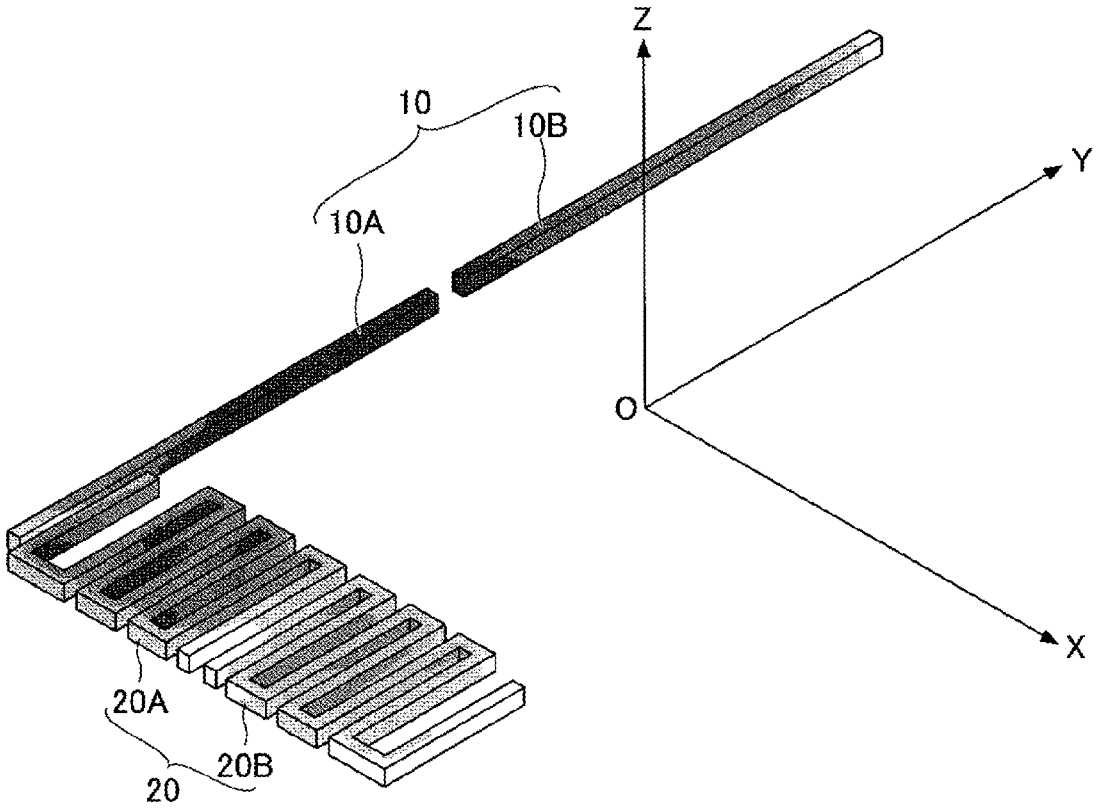
FIG. 3 is a schematic view illustrating current distribution at antenna elements 10-20 obtained by an electromagnetic field simulation.

FIG. 3 is a schematic view illustrating current distribution at the antenna elements 10-20 obtained by an electromagnetic field simulation. The current distribution illustrated in FIG. 3 is obtained with a simulation in a state where power is fed to the antenna element 10 in the antenna apparatus 100 according to the first embodiment.

As illustrated in FIG. 3, current distribution is observed in the antenna element 20 even if power is fed only to the antenna element 10.

Especially, the element 20A that is closer to the antenna element 10 has greater current distribution than the element 20B.

As above, the antenna apparatus 100 can be made smaller according to the first embodiment.

Second Embodiment

Figure 4:
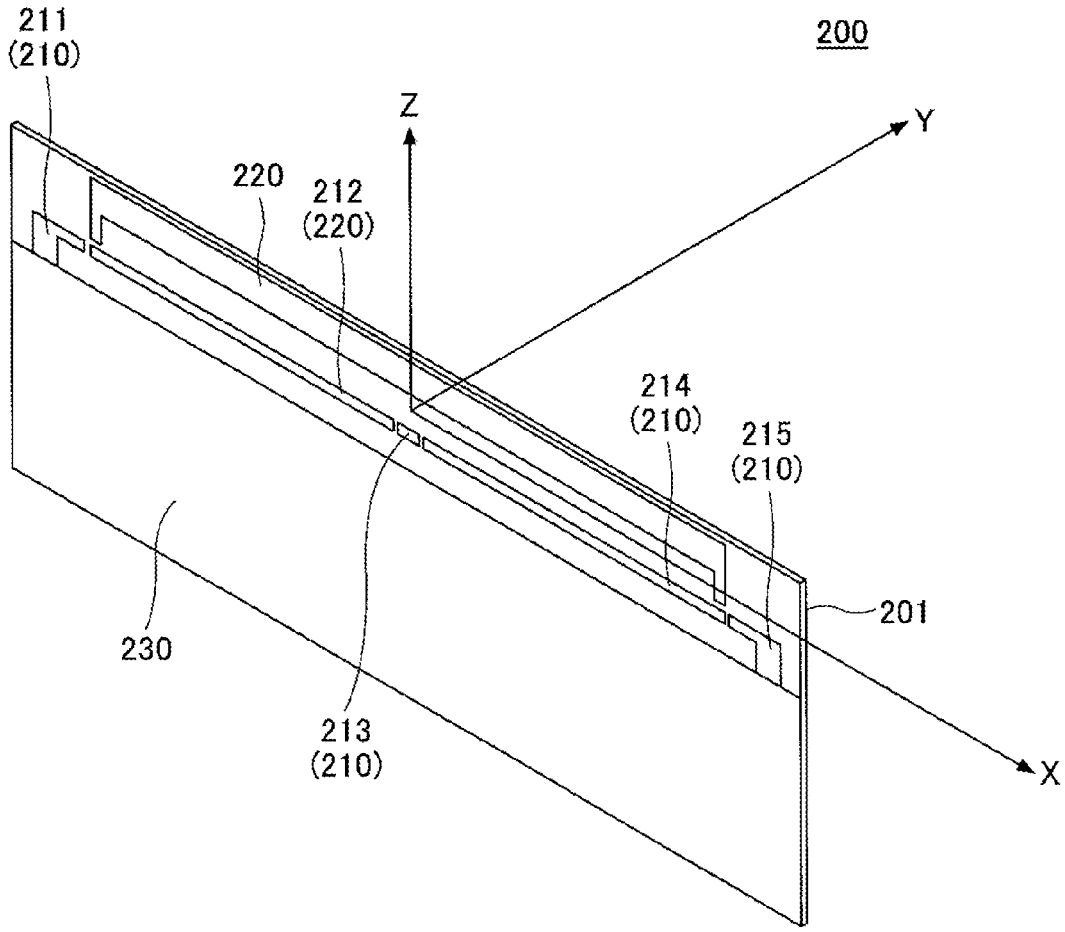
FIG. 4 is a perspective view illustrating an antenna apparatus 200 according to a second embodiment.
Figure 5:
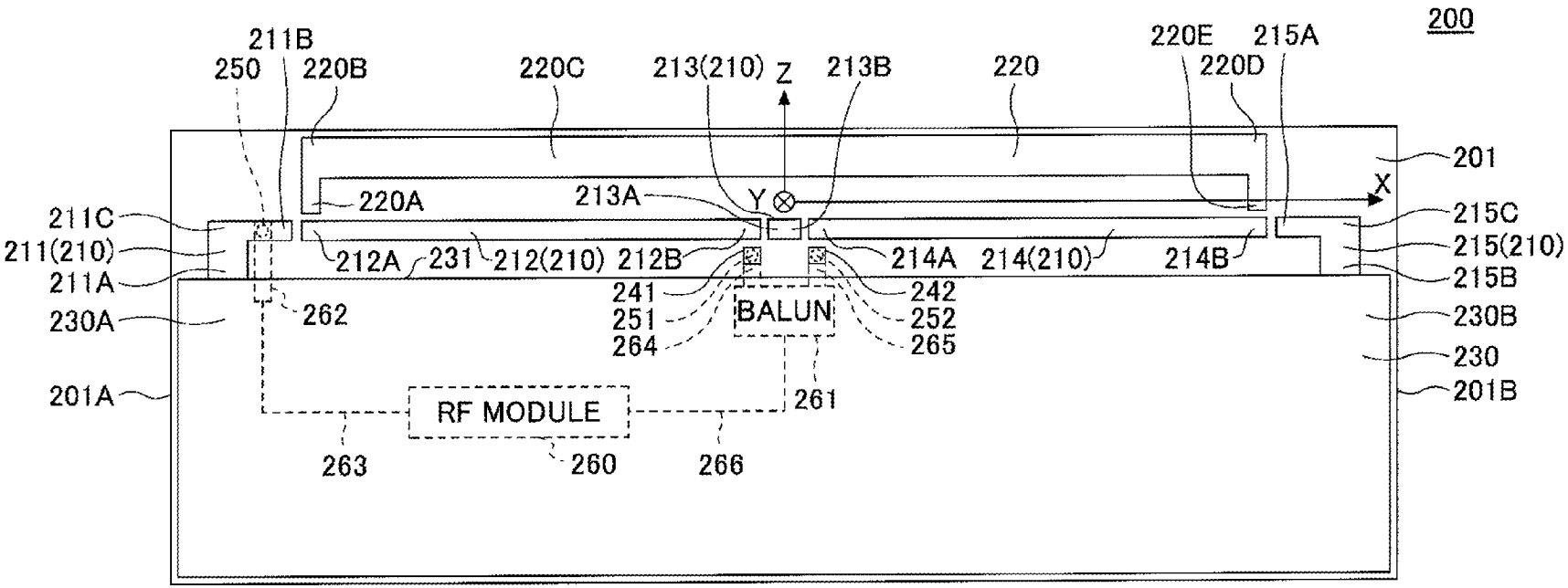
FIG. 5 is a plane view illustrating the antenna apparatus 200 according to the second embodiment.
Figure 6:
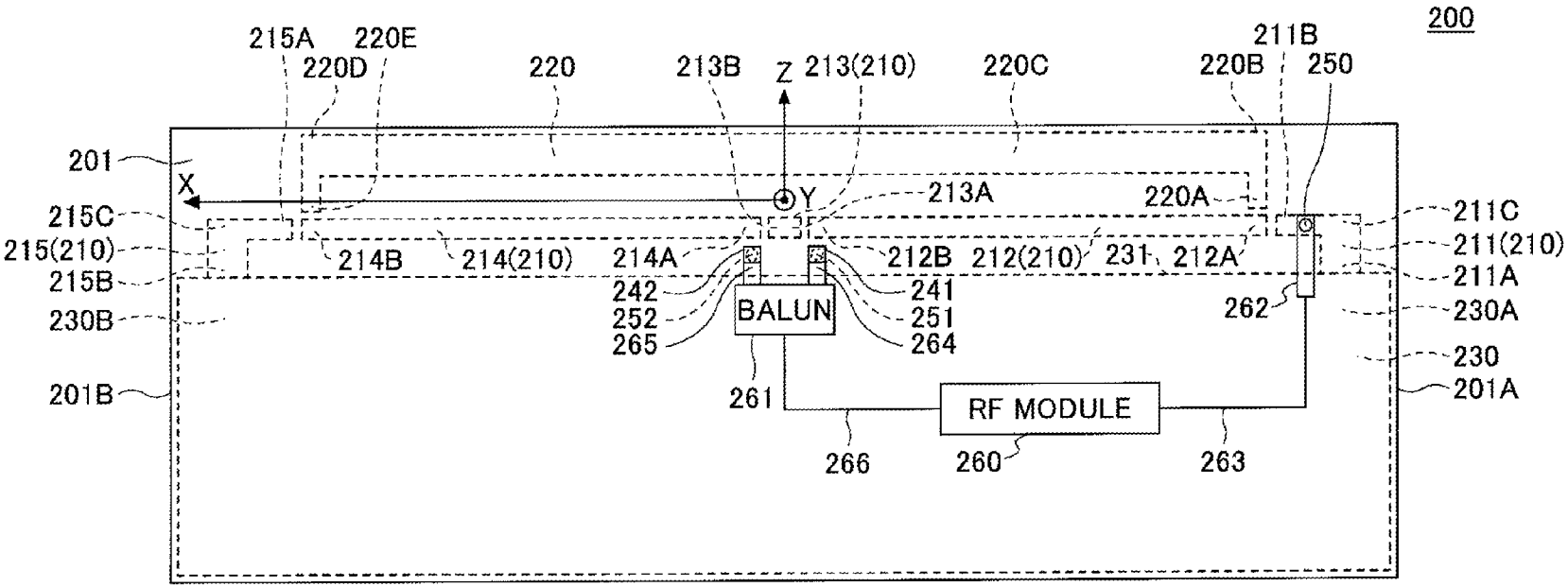
FIG. 6 is a bottom view illustrating the antenna apparatus 200 according to the second embodiment.

FIG. 4 is a perspective view illustrating an antenna apparatus 200 according to the second embodiment. FIG. 5 is a plane view illustrating the antenna apparatus 200 according to the second embodiment. FIG. 6 is a bottom view illustrating the antenna apparatus 200 according to the second embodiment.

According to the second embodiment, the antenna apparatus 200 includes a circuit board 201, antenna elements 210-220, and a ground element 230.

According to the second embodiment, similar to the first embodiment, the antenna apparatus 200 is a device for communication using a diversity antenna that may be used to configure a wireless sensor network and receive information to be detected by a node (wireless terminal).

Here, the X-Y-Z coordinate system in the second embodiment is set differently from the one in the first embodiment. In the second embodiment, the X-Y-Z coordinate system is defined as an orthogonal coordinate system whose origin is set at a point on the surface (the illustrated sides in FIGS. 4-5) of the circuit board 201.

The X-axis extends in the longitudinal direction from the center O of the antenna apparatus 200, the Y-axis extends towards the back side of the circuit board 201 from the center O, and the Z-axis extends vertically upward from the center O. In the second embodiment, the origin is positioned at the center of an area between the antenna elements 210-220.

The antenna elements 210-220 and ground element 230 have line symmetrical forms (patterns) across the Z-axis.

Also, for the sake of simplicity for explanation, configuration elements on the back (bottom) side of the circuit board 201 in FIG. 4 are not illustrated although the configuration elements on the back (bottom) side of the circuit board 201 are designated with dashed lines in FIG. 5. The configuration elements on the back (bottom) side of the circuit board 201 are illustrated in FIG. 6.

The circuit board 201 has a rectangular plate-shaped form in plane view, whose longitudinal direction is along the X-axis direction, and its lateral direction is along the Z-axis direction. The thickness of the circuit board 201 is the length in the Y-axis direction. The circuit board 201 is, for example, an insulated circuit board compliant with FR-4 (Flame Retardant type 4) standards.

The antenna elements 210-220 and ground element 230 are formed on the surface of the circuit board 201. The antenna elements 210-220 and ground element 230 are formed, for example, with generating patterns by applying etching or the like to copper foil formed on the surface of the circuit board 201.

The antenna element 210 includes elements 211-215.

The ground element 230 extends on the surface of the circuit board 201 in the Z-axis negative direction, between edge lines of the circuit board 201 crossing the X-axis, namely, one edge line 201A (an edge line in the X-axis negative direction, extending in the Z-axis direction), and another edge line 201B (an edge line in the X-axis positive direction, extending in the Z-axis direction). The ground element 230 is an example of a ground plate.

Here, one of the four edge lines of the ground element 230 is referred to as an edge line 231 that extends in the X-axis direction in the vicinity of and along the antenna element 210.

The antenna element 210 (elements 211-215) and the antenna element 220 are used to configure a slot antenna and a folded dipole antenna, to which a connection is turned over from the one to the other by switches, which will be described later.

The slot antenna is configured with the elements 211-215 of the antenna element 210 and the ground element 230. Also, the folded dipole antenna is configured with the elements 212 and 214 of the antenna element 210 and the antenna element 220. Connection switching between the slot antenna and the folded dipole antenna by switches will be described later with reference to FIG. 7.

Here, the configuration of the antenna element 210 will be described. As described above, the antenna element 210 includes the elements 211-215. The antenna element 210 is an example of a first element.

The element 211 is a conductor with an L-shaped form in plane view, whose one terminal 211A is connected to a corner part 230A of the ground element 230 and whose other terminal 211B is disposed in the vicinity of one terminal 212A of the element 212 in the X-axis negative direction. The element 211 is folded at a folded part 211C positioned between the one terminal 211A and the other terminal 211B.

Also, a via 250 is connected with the element 211 at a bit more negative position in the X-axis than the position of the other terminal 211B (closer to the one terminal 211A) for feeding power to the antenna element 210. The via 250 is produced by plating a through hole that penetrates the circuit board 201 from the surface to the back with copper to form a film or the like. The via 250 is formed to connect the element 211 with an RF (Radio Frequency) module 260 disposed on the back of the circuit board 201. The point where the element 211 is connect with the via 250 is an example of a second power feeding portion.

The one terminal 212A of the element 212 is disposed in the vicinity of the other terminal 211B of the element 211 in the X-axis positive direction, and another terminal 212B is disposed in the vicinity of one terminal 213A of the element 213. The element 212 is a line-shaped conductor extending along the X-axis. The other terminal 212B of the element 212 is positioned at a negative position in the X-axis direction from the origin O. A pad 241 is disposed in the Z-axis negative direction relative to the other terminal 212B of the element 212.

The one terminal 213A of the element 213 is disposed in the vicinity of the other terminal 212B of the element 212 in the X-axis positive direction, and another terminal 213B is disposed in the vicinity of one terminal 214A of the element 214 in the X-axis negative direction.

The element 213 is a very short line-shaped conductor extending along the X-axis direction. The midpoint of the element 213 in the X-axis direction coincides with the origin O in the X-axis direction. Namely, the X-axis coordinate value of the midpoint of the element 213 is X=0.

The one terminal 214A of the element 214 is disposed in the vicinity of the other terminal 213B of the element 213 in the X-axis positive direction, and another terminal 214B is disposed in the vicinity of one terminal 215A of the element 215 in the X-axis negative direction. The element 214 is a line-shaped conductor extending along the X-axis. The element 214 is disposed at the line-symmetric position with the element 212 across the Z-axis. A pad 242 is disposed at a position in the Z-axis negative direction relative to the one terminal 214A of the element 214.

The one terminal 215A of the element 215 is disposed in the vicinity of the other terminal 214B of the element 214 in the X-axis positive direction, and another terminal 215B is connected with a corner part 230B of the ground element 230. The element 215 is an L-shaped conductor disposed at the line-symmetric position with the element 211 across the Z-axis. The element 215 is folded at a folded part 215C positioned between the one terminal 215A and the other terminal 215B. Here, the element 215 does not have a power feeding portion, which is different from the element 211.

In the antenna element 210 described above, the length between the folded part 211C of the element 211 and the folded part 215C of the element 215 in the X-axis direction is set to half of the wavelength (λ) of the operational frequency of the antenna apparatus 200 according to the second embodiment.

The antenna element 220 includes one terminal 220A, a folded part 220B, a straight line part 220C, a folded part 220D, and another terminal 220E. The antenna element 220 is an example of a second element, which is disposed along the antenna element 210 on the opposite side of the ground element 230 relative to the antenna element 210 in plane view.

The antenna element 220 has a form that extends a bit in the Z-axis positive direction from the one terminal 220A, turns by 90 degrees in the X-axis positive direction at the folded part 220B, extends with the straight line part 220C, turns by 90 degrees in the Z-axis negative direction at the folded part 220D, extends a bit in the Z-axis negative direction, and reaches the other terminal 220E.

The one terminal 220A is disposed in the vicinity of the one terminal 212A of the element 212 in the Z-axis positive direction, and the other terminal 220E is disposed in the vicinity of the other terminal 214B of the element 214 in the Z-axis positive direction. The midpoint of the straight line part 220C in the X-axis direction coincides with the origin O in the X-axis direction. Namely, the X-axis coordinate value of the midpoint of the straight line part 220C is X=0.

In the antenna element 220 described above, the length between the folded part 220B and the folded part 220D in the X-axis direction is set to half of the wavelength (λ) of the operational frequency of the antenna apparatus 200 according to the second embodiment.

Here, according to the second embodiment, although the length between the folded part 220B and the folded part 220D in the X-axis direction is a bit shorter than the length between the folded part 211C of the element 211 and the folded part 215C of the element 215 in the X-axis direction, both of the lengths are set to about λ/2. Both of the lengths may be set to an appropriate length using λ/2 as a reference, depending on characteristics of the folded dipole antenna and the slot antenna or the like, which will be described later.

The pads 241-242 are disposed in the Z-axis negative direction relative to the other terminal 212B of the element 212, and in the Z-axis negative direction relative to the one terminal 214A of the element 214, respectively. The pads 241-242 have line-symmetric forms and positions with each other across the Z-axis.

The pads 241-242 are connected with vias 251-252, respectively. The vias 251-252 are produced by plating through holes that penetrate the circuit board 201 from the surface to the back with copper to form films or the like. The vias 251-252 are formed to connect the pads 241-242 with the RF module 260 disposed on the back of the circuit board 201 via a balun 261.

Here, the pads 241-242 are connected with the other terminal 212B of the element 212 and the one terminal 214A of the element 214 via distinct switches, respectively. The other terminal 212B of the element 212 and the one terminal 214A of the element 214 are fed with power from the RF module 260 via the pads 241-242, respectively.

As illustrated in FIG. 6, the RF module 260, the balun 261, the pad 262, a coaxial cable 263, pads 264-265, and a coaxial cable 266 are formed on the back of the circuit board 201.

The RF module 260 is a device for feeding power to the antenna elements 210-220, and connected with a power source (not illustrated). It is desirable for the RF module 260 to be disposed in an area overlapped with the ground element 230 in plane view from a standpoint of suppressing noise or the like.

The RF module 260 is connected with the pad 262 via the coaxial cable 263, and also connected with the balun 261 via the coaxial cable 266. More specifically, the pad 262 is connect with the core wire of the coaxial cable 263, and the shielding wire of the coaxial cable 263 is connected with the ground element 230 in the vicinity of the pad 262, for example, by forming a via or the like in the vicinity of the pad 262. Also, the core wire and shielding wire of the coaxial cable 266 are connected with the balun 261.

Here, the balun 261 is disposed between the elements 211-215 (or 212 and 214) of the antenna element 210 and the RF module 260, which is a kind of converter to convert an equilibrium state of the antenna element 210 into a non-equilibrium state of the RF module 260.

The pads 262, 264, and 265 are formed, for example, with generating patterns by applying etching or the like to copper foil or the like formed on the back of the circuit board 201.

The pad 262 is connected with the element 211 through the via 250. The pad 264 is connected with the pad 241 (see FIG. 5) through the via 251. The pad 265 is connected with the pad 242 (see FIG. 5) through the via 252.

Next, with reference to FIGS. 7-8, switches connected with the antenna element 210-220 and ground element 230, and a slot antenna and a folded dipole antenna configured with the antenna element 210-220 and ground element 230 will be described.

Figure 7:
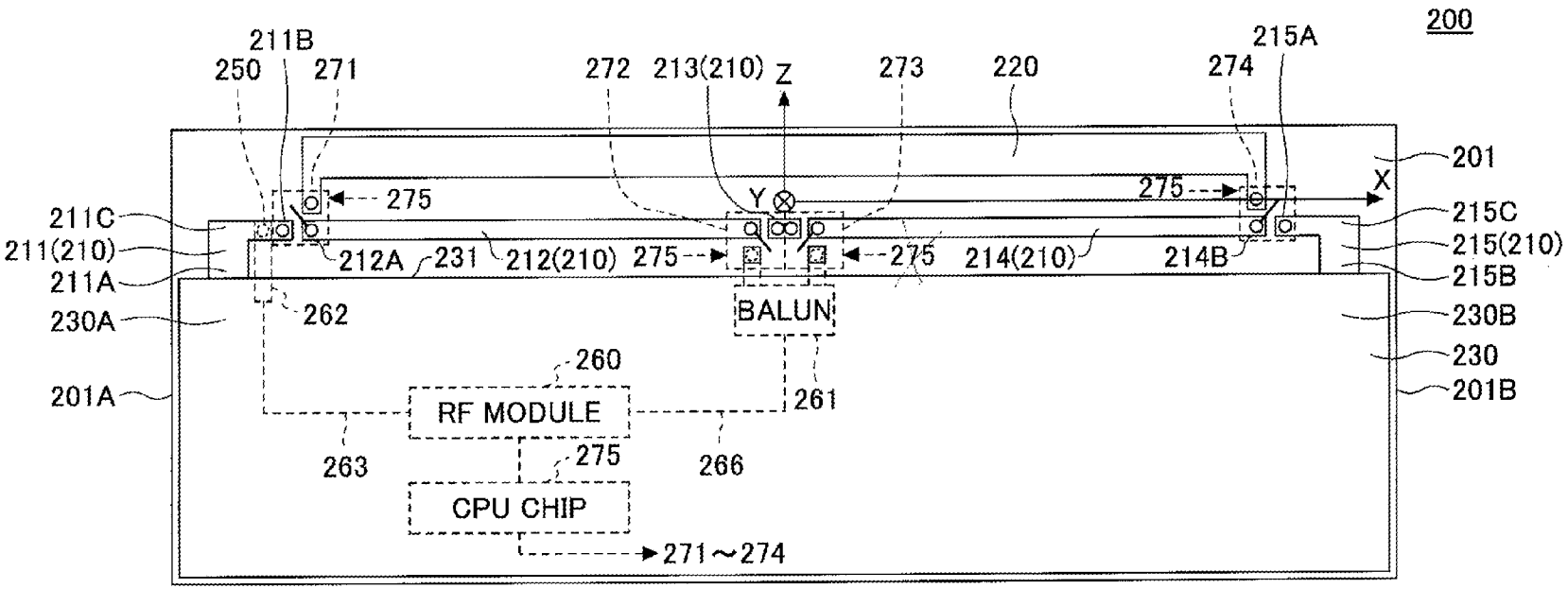
FIG. 7 is a schematic view illustrating switches used for configuring a slot antenna and a folded dipole antenna in the antenna apparatus 200 according to the second embodiment.

FIG. 7 is a schematic view illustrating switches used for configuring a slot antenna and a folded dipole antenna in the antenna apparatus 200 according to the second embodiment.

Figure 8A:
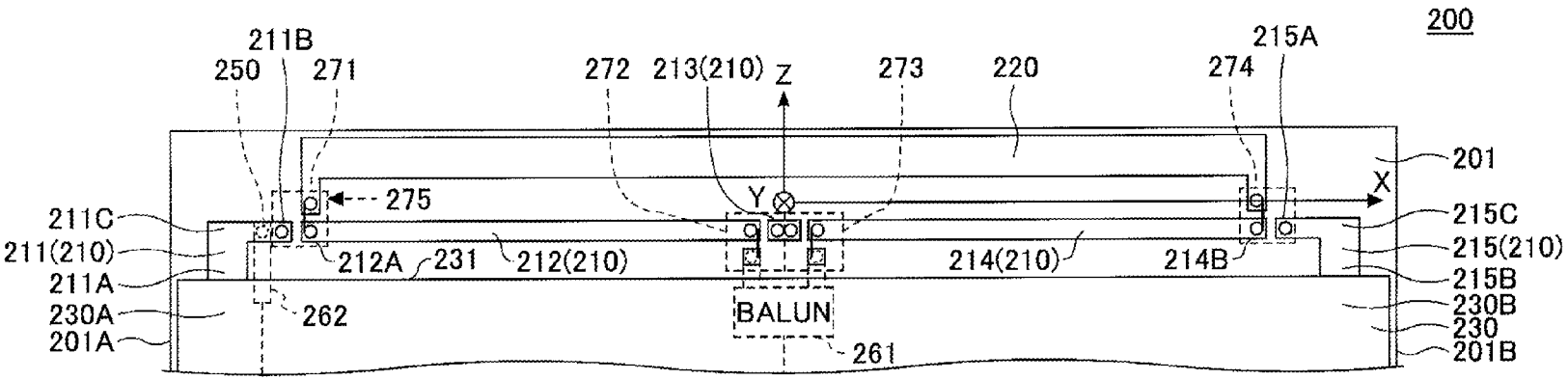
FIGS. 8A-8B are schematic views illustrating states in which switches are turned over in the antenna apparatus 200 according to the second embodiment.
Figure 8B:
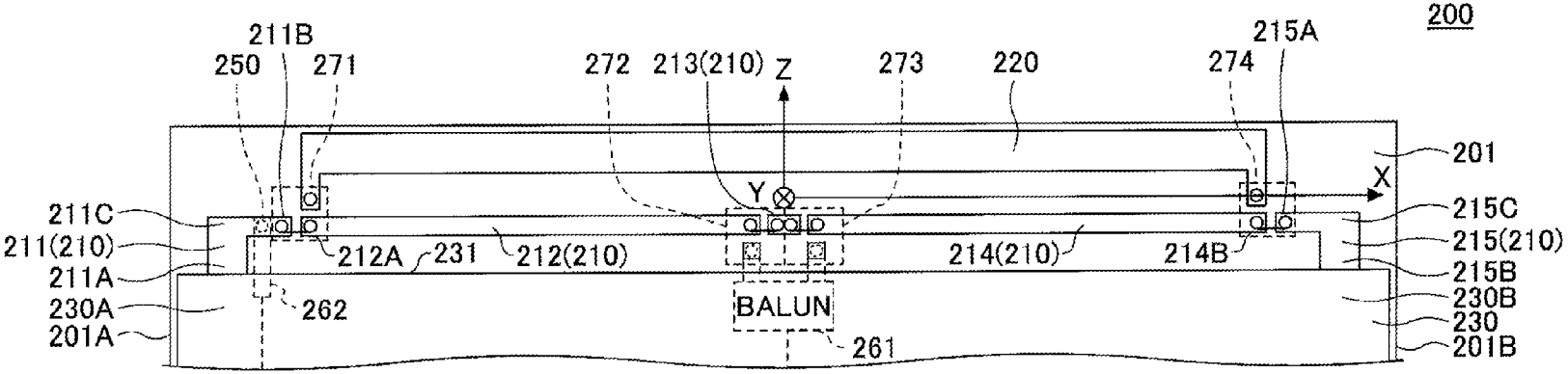

FIGS. 8A-8B are schematic views illustrating states in which the switches are turned over in the antenna apparatus 200 according to the second embodiment. FIG. 8A illustrates a state in which a folded dipole antenna is configured, and FIG. 8B illustrates a state in which a slot antenna is configured.

As illustrated in FIG. 7, the antenna apparatus 200 includes the switches 271, 272, 273, and 274 and a CPU chip 275 according to the second embodiment. The switches 271-274 are three-terminal switches, respectively. For the switches 271-274, for example, SPDT (Single Pole Double Throw) switches may be used, or alternatively, PIN (p-intrinsic-n Diode) diodes or mechanical switches may be used.

The switch 271 connects the one terminal 212A of the element 212 with one of the other terminal 211B of the element 211 and the one terminal 220A of the antenna element 220.

The switch 272 connects the other terminal 212B of the element 212 with one of the one terminal 213A of the element 213 and the pad 241.

The switch 273 connects the one terminal 214A of the element 214 with one of the other terminal 213B of the element 213 and the pad 242.

The switch 274 connects the other terminal 214B of the element 214 with one of the one terminal 215A of the element 215 and the other terminal 220E of the antenna element 220.

Here, the switches 271-274 are examples of connecting parts. Among these, the switches 272 and 273 are examples of first connecting parts, and the switches 271 and 274 are examples of second connecting parts.

The CPU chip 275 is disposed on the back of the circuit board 201, connected with the switches 271-274 via a signal line designated by a dashed arrow, and also connected with the RF module 260. The CPU chip 275 executes open/close control of the switches 271-274 for selecting one of the folded dipole antenna and the slot antenna depending on a communication state. The CPU chip 275 is an example of a control section to control connection states of the switches 271-274.

Here, a signal line connecting the CPU chip 275 with the switches 271-274 may be wired in a way that does not have an influence on the impedance of the folded dipole antenna and the slot antenna. Also, although it is described here that the CPU chip 275 controls the switches 271-274 in the present embodiment, the CPU chip 275 may control the switches 271-274 via the RF module 260, or the RF module 260 may control the switches 271-274.

Next, with reference to FIGS. 8A-8B, turning over of the switches 271-274 will be described. In FIGS. 8A-8B, only a neighboring part of the edge line 231 of the ground element 230 is illustrated due to space limitation.

When configuring the folded dipole antenna as illustrated in FIG. 8A, the switch 271 connects the one terminal 212A of the element 212 with the one terminal 220A of the antenna element 220. The switch 272 connects the other terminal 212B of the element 212 with the pad 241. The switch 273 connects the one terminal 214A of the element 214 with the pad 242. Also, the switch 274 connects the other terminal 214B of the element 214 with the other terminal 220E of the antenna element 220.

In this way, the folded dipole antenna is configured that includes the elements 212 and 214 of the antenna element 210 and the antenna element 220, and has the other terminal 212B of the element 212 and the one terminal 214A of the element 214 as power feeding portions (first power feeding portions). The other terminal 212B and the one terminal 214A are fed with power via the pads 241-242, respectively.

The folded dipole antenna is configured by connecting the first terminal part (the one terminal 212A of the element 212) and the second terminal part (the other terminal 214B of the element 214) of the antenna element 210 as an example of the first element, with the first terminal part (one terminal 220A) and the second terminal part (other terminal 220E) of the antenna element 220 as an example of the second element, respectively.

Also, the folded dipole antenna is fed with power by supplying high-frequency signals in reversed phases to each other to the elements 212 and 214 from the RF module 260 via the switches 272-273, pads 241-242, vias 251-252, balun 261, and coaxial cable 266 (see FIGS. 5-6).

The folded dipole antenna has its polarization directed for the horizontally polarized wave (X-axis direction) to obtain a polarized wave in the direction parallel to the longitudinal direction of the folded dipole antenna. The longitudinal direction of the folded dipole antenna is in the X-axis direction. In other words, the longitudinal direction of the folded dipole antenna is the direction coming from the one terminal 212A of the element 212 towards the other terminal 214B of the element 214, or the direction opposite to it. Also, the longitudinal direction of the folded dipole antenna is the direction in which the straight line part 220C of the antenna element 220 extends.

Also, when configuring the slot antenna as illustrated in FIG. 8B, the switch 271 connects the one terminal 212A of the element 212 with the other terminal 211B of the element 211. The switch 272 connects the other terminal 212B of the element 212 with the one terminal 213A of the element 213. The switch 273 connects the one terminal 214A of the element 214 with the other terminal 213B of the element 213. Also, the switch 274 connects the other terminal 214B of the element 214 with the one terminal 215A of the element 215.

In this way, the slot antenna is configured that includes the elements 211-215 of the antenna element 210 and a part of the ground element 230 on the side of the edge line 231, and is fed with power through the via 250.

The slot antenna is configured by connecting the first terminal part (the one terminal 211A of the element 211) and the second terminal part (the other terminal 215B of the element 215) of the antenna element 210 as an example of the first element, with the ground element 230 as an example of the ground plate.

Also, the slot antenna is fed with power by supplying high-frequency signals to the antenna element 210 from the RF module 260 through the via 250, pad 262, and coaxial cable 263. The antenna element 210 of the slot antenna and a part of the ground element 230 on the side of the edge line 231 are supplied with high-frequency signals in reversed phases to each other from the RF module 260 because the shielding wire of the coaxial cable 263 is connected with the ground element 230.

The slot antenna has its polarization directed for the vertically polarized wave (Z-axis direction) to obtain a polarized wave in the direction orthogonal to the longitudinal direction of the slot antenna. In other words, with the slot antenna, a polarization is generated in the direction between a part of the antenna element 210 mainly around the elements 212, 213, and 214 (a part extending in the X-axis direction), and the edge line 231 of the ground element 230.

As above, in the antenna apparatus 200 according to the second embodiment, the polarization direction (horizontal polarized wave) obtained by the folded dipole antenna configured with the antenna elements 210-220 and ground element 230 differs from the polarization direction (vertical polarized wave) obtained with the slot antenna by 90 degrees.

Here, when configuring the folded dipole antenna, the first terminal part of the antenna element 210 as an example of the first element is the one terminal 212A of the element 212, and the second terminal part of the antenna element 210 as an example of the first element is the other terminal 214B of the element 214.

Also, when configuring the slot antenna, the first terminal part of the antenna element 210 as an example of the first element is the one terminal 211A of the element 211, and the second terminal part of the antenna element 210 as an example of the first element is the other terminal 215B of the element 215.

As above, the first terminal part of the antenna element 210 as an example of the first element is not limited to the one terminal 211A at the edge of the antenna element 210 in the X-axis negative direction, but also includes the one terminal 212A of the element 212.

This is because characteristics of the folded dipole antenna are hardly influenced when treating the one terminal 212A of the element 212 as the first terminal part because the length of the element 211 is miniscule in the total length of the antenna element 210.

Also, the second terminal part of the antenna element 210 as an example of the first element is not limited to the other terminal 215B at the edge of the antenna element 215 in the X-axis negative direction, but also includes the other terminal 214B of the element 214.

This is because characteristics of the folded dipole antenna are hardly influenced when treating the other terminal 214B of the element 214 as the second terminal part because the length of the element 215 is miniscule in the total length of the antenna element 210.

Next, with reference to FIG. 9, current distribution in the folded dipole antenna and the slot antenna in the antenna apparatus 200 will be described according to the second embodiment.

Figure 9A:
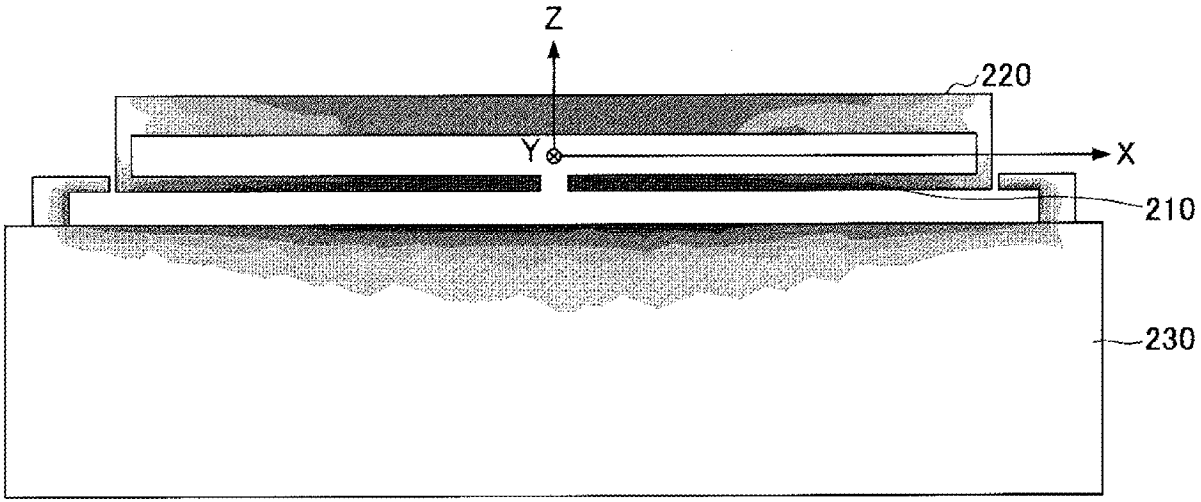
FIGS. 9A-9B are schematic views illustrating current distribution of the folded dipole antenna and the slot antenna in the antenna apparatus 200 according to the second embodiment.
Figure 9B:
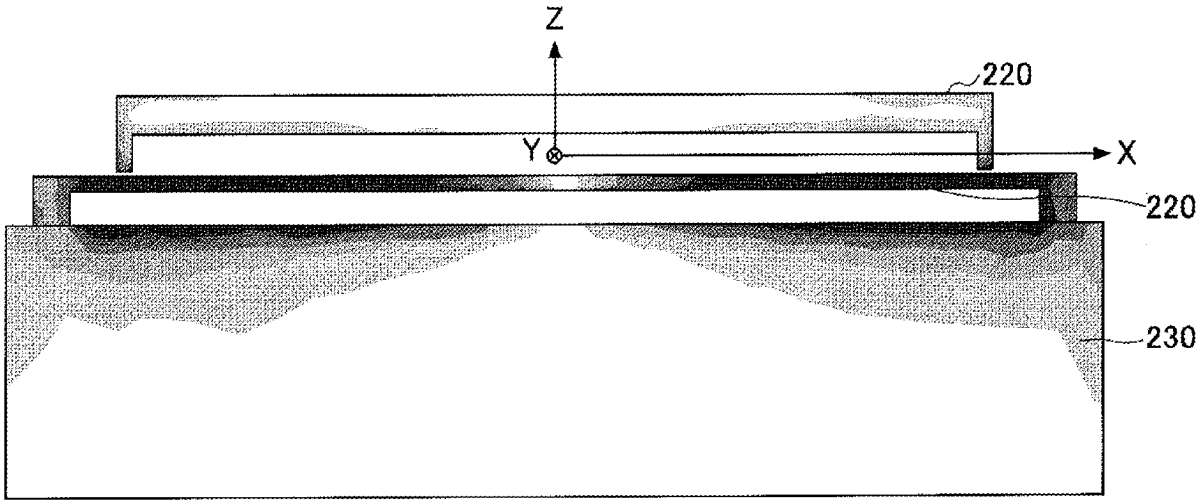

FIGS. 9A-9B are schematic views illustrating current distribution of the folded dipole antenna and the slot antenna in the antenna apparatus 200 according to the second embodiment.

In FIGS. 9A-9B, to make current distribution easy to view, only the outline forms of the antenna element 210 (the elements 211-215), the antenna element 220, and the ground element 230 are illustrated. Also, only main numerical codes (the antenna element 210, the antenna element 220, and the ground element 230) are designated, and the other numerical codes are omitted. For the other numerical codes, see FIGS. 5, 6, and 7.

FIG. 9A is a schematic view illustrating current distribution obtained when the antenna apparatus 200 operates as the folded dipole antenna according to the second embodiment. The current distribution is obtained with an electromagnetic field simulation.

The current distribution is obtained by feeding power to the folded dipole antenna by supplying high-frequency signals in reversed phases to each other to the elements 212 and 214 from the RF module 260 via the switches 272-273, pads 241-242, vias 251-252, balun 261, and coaxial cable 266 (see FIGS. 5-6).

In FIG. 9A, a dark part indicates a part where the current density is high, whereas a bright part indicates a part where the current density is low. As illustrated in FIG. 9A, the current densities are high at a part of the element 212 of the antenna element 210 closer to the other terminal 212B in the longitudinal direction relative to the center of the element 212, a part of the element 214 closer to the one terminal 214A in the longitudinal direction relative to the center of the element 214, and the middle part of the straight line part 220C of the antenna element 220 in the longitudinal direction.

Also, the current densities are low at a part of the element 212 of the antenna element 210 closer to the one terminal 212A in the longitudinal direction relative to the center of the element 212, a part of the element 214 closer to the other terminal 214B in the longitudinal direction relative to the center of the element 214, and both of the ends of the straight line part 220C of the antenna element 220 in the longitudinal direction.

As above, when the antenna apparatus 200 operates as the folded dipole antenna according to the second embodiment, it is understood that the current density becomes high at the center part of the folded dipole antenna in the X-axis direction (longitudinal direction), and the current density becomes low at both of the terminal parts.

Therefore, it is confirmed that horizontal polarization (X-axis direction) is obtained with the folded dipole antenna.

Also, FIG. 9B is a schematic view illustrating current distribution obtained when the antenna apparatus 200 operates as the slot antenna according to the second embodiment. The current distribution is obtained with an electromagnetic field simulation.

The current distribution is obtained by feeding power to the slot antenna by supplying high-frequency signals in reversed phases to each other to the element 211 and the ground element 230 from the RF module 260 through the via 250, pad 262, and coaxial cable 263 (see FIG. 5 and FIG. 6).

In FIG. 9B, a dark part indicates a part where the current density is high, whereas a bright part indicates a part where the current density is low. As illustrated in FIG. 9B, the current densities are high at a part of the element 212 of the antenna element 210 closer to the one terminal 212A in the longitudinal direction relative to the center of the element 212, a part of the element 214 closer to the other terminal 214B in the longitudinal direction relative to the center of the element 214, and both of the terminal parts of the edge line 231 of the ground element 230.

Also, the current densities are low at a part of the element 212 of the antenna element 210 closer to the other terminal 212B in the longitudinal direction relative to the center of the element 212, a part of the element 214 closer to the one terminal 214A in the longitudinal direction relative to the center of the element 214, and the middle part of the edge line 231 of the ground element 230.

As above, when the antenna apparatus 200 operates as the slot antenna according to the second embodiment, it is understood that the current density becomes low at the center part of the folded dipole antenna in the X-axis direction (longitudinal direction), and the current density becomes high at both of the terminal parts.

Therefore, it is confirmed that vertical polarization (Z-axis direction) is obtained with the slot antenna.

Next, with reference to FIGS. 10A-10B and 11A-11B, directivity patterns and VSWR (Voltage Standing Wave Ratio) characteristics will be described that are obtained with the antenna apparatus 200 according to the second embodiment.

Figure 10A:
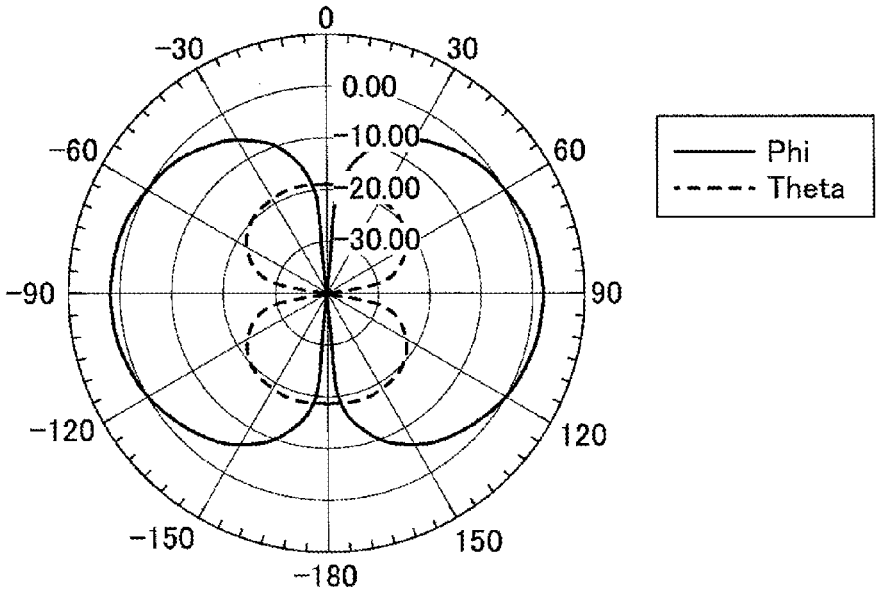
FIGS. 10A-10B are schematic views illustrating a directivity pattern and a VSWR characteristic on the X-Y plane obtained when the antenna apparatus 200 operates as a folded dipole antenna according to the second embodiment.
Figure 10B:
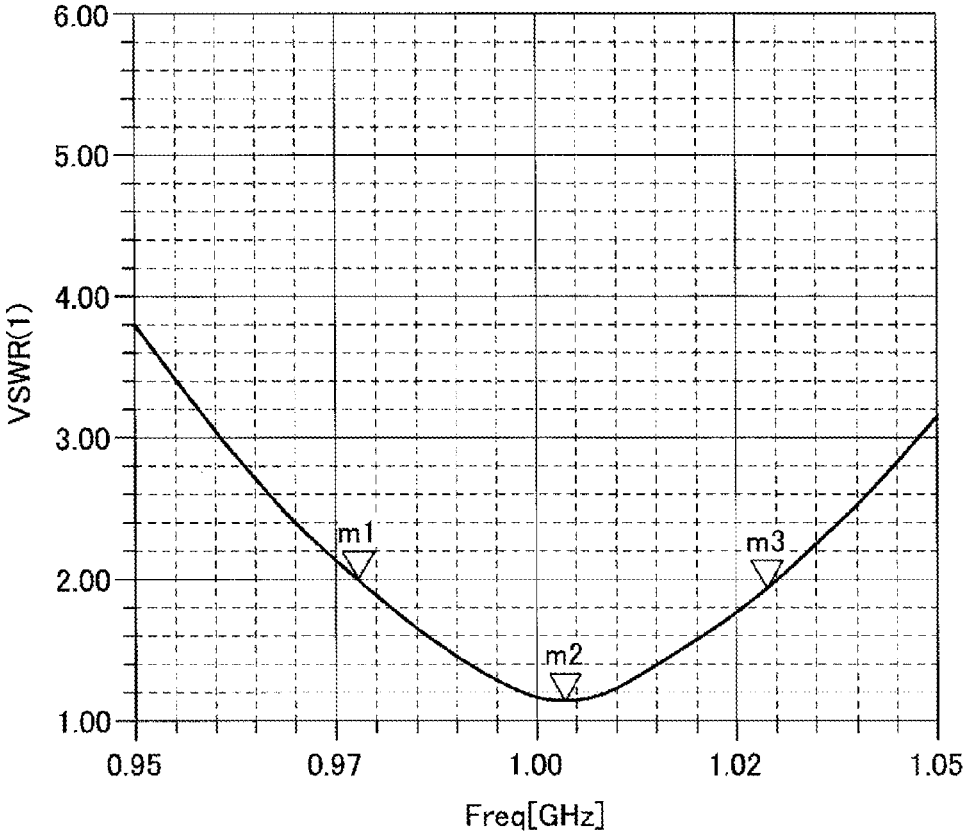

FIGS. 10A-10B are schematic views illustrating a directivity pattern and a VSWR characteristic on the X-Y plane obtained when the antenna apparatus 200 operates as the folded dipole antenna according to the second embodiment.

FIGS. 10A-10B illustrate results obtained with an electromagnetic field simulation in which the operational frequency of the folded dipole antenna in the antenna apparatus 200 is set to 1 GHz. In FIG. 10A, gain of $\phi$ component is designated with a solid line, and gain in $\theta$ component is designated with a dashed line.

As illustrated in FIG. 10A, the directivity pattern of the folded dipole antenna on the X-Y plane indicates high gain in ϕ component designated with the solid lines, whose value is about 0 dBi. Also, the gain in θ component designated with the dashed line is low at about −20 dBi.

Therefore, it is confirmed that when operating the antenna apparatus 200 as the folded dipole antenna, only the folded dipole antenna operates, and almost no radiation is generated from the slot antenna.

Also, as for the VSWR characteristic illustrated in FIG. 10B, a very favorable value of about 1.2 is obtained as a minimal value at the operational frequency of 1 GHz.

As above, when operating the antenna apparatus 200 as the folded dipole antenna, it is understood that the correlation between the folded dipole antenna and the slot antenna is very low.

Figure 11A:
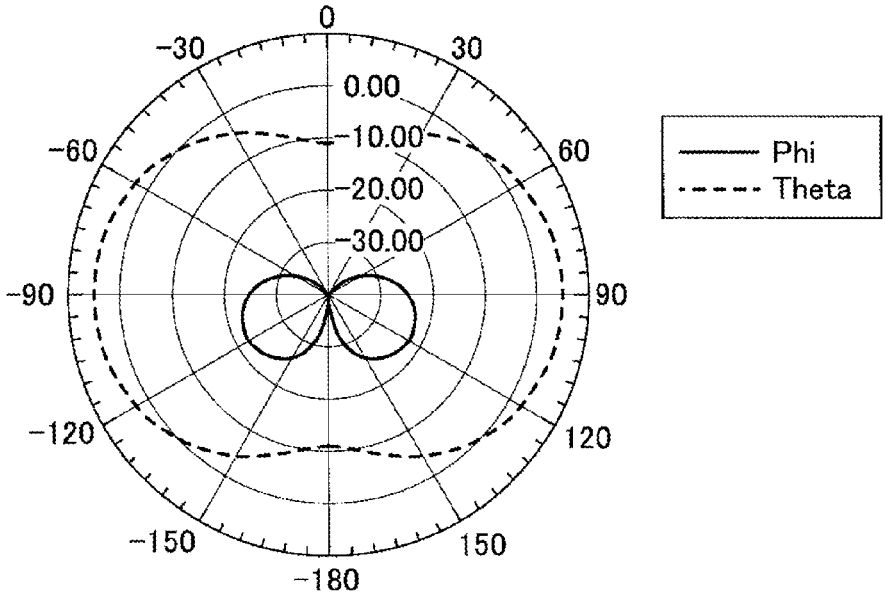
FIGS. 11A-11B are schematic views illustrating a directivity pattern and a VSWR characteristic on the X-Y plane obtained when the antenna apparatus 200 operates as a slot antenna according to the second embodiment.
Figure 11B:
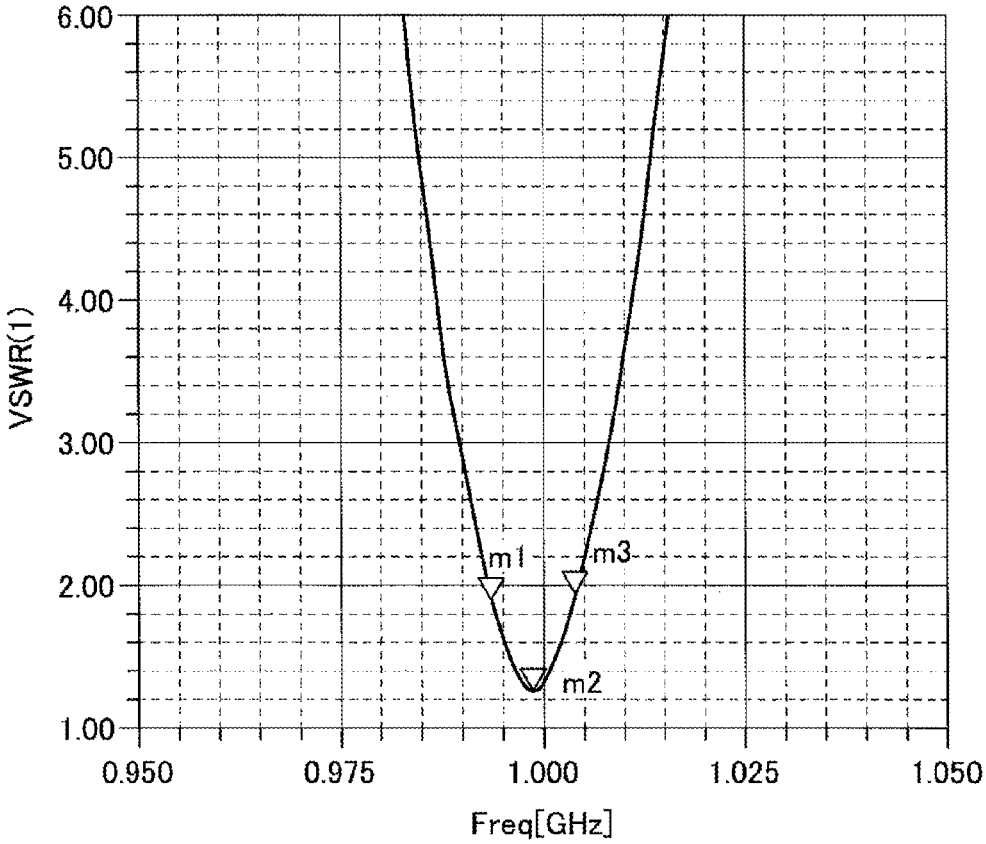

FIGS. 11A-11B are schematic views illustrating a directivity pattern and a VSWR characteristic on the X-Y plane obtained when the antenna apparatus 200 operates as the slot antenna according to the second embodiment.

FIGS. 11A-11B illustrate results obtained with an electromagnetic field simulation in which the operational frequency of the folded dipole antenna in the antenna apparatus 200 is set to 1 GHz. In FIG. 11A, gain in ϕ component is designated with a solid line, and gain in θ component is designated with a dashed line.

As illustrated in FIG. 11A, the directivity pattern of the slot antenna on the X-Y plane indicates high gain in θ component designated with the dashed line, whose values is about 0 dBi to +5 dBi. Also, the gain in ϕ component designated with the solid line is low at about −23 dBi.

Therefore, it is confirmed that when operating the antenna apparatus 200 as the slot antenna, only the slot antenna operates, and almost no radiation is generated from the folded dipole antenna.

Also, as for the VSWR characteristic illustrated in FIG. 11B, a very favorable value of about 1.2 is obtained as a minimal value at the operational frequency of 1 GHz.

As above, when operating the antenna apparatus 200 as the slot antenna, it is understood that the correlation between the slot antenna and the folded dipole antenna is very low.

With the antenna apparatus 200 described above according to the second embodiment, it is possible to configure the folded dipole antenna and the slot antenna with a low correlation by turning over the switches 271-274.

As illustrated in FIG. 5, the folded dipole antenna is an antenna that includes the elements 212 and 214 of the antenna element 210 and the antenna element 220, and has the other terminal 212B of the element 212 and the one terminal 214A of the element 214 as power feeding portions (first power feeding portions).

Also as illustrated in FIG. 5, the slot antenna is an antenna that includes the elements 211-215 of the antenna element 210 and a part of the ground element 230 on the side of the edge line 231, and is fed with power through the via 250.

As above, the folded dipole antenna and the slot antenna implemented in the antenna apparatus 200 share the antenna element 210 (at least the elements 212 and 214) according to the second embodiment.

Namely, according to the second embodiment, the antenna apparatus 200 is obtained by sharing parts between the folded dipole antenna that has its longitudinal direction in the X-axis direction and the slot antenna that also has its longitudinal direction in the X-axis direction, and placing them adjacent to each other in the Z-axis direction.

In other words, the antenna apparatus 200 is obtained by combining (or uniting) parts of the folded dipole antenna that has its longitudinal direction in the X-axis direction and the slot antenna that also has its longitudinal direction in the X-axis direction, and placing them adjacent to each other in the Z-axis direction.

Thus, the antenna apparatus 200 realizes to be made small in which the folded dipole antenna and the slot antenna are interchangeably implemented.

Therefore, according to the second embodiment, it is possible to provide the antenna apparatus 200 that is intended to be made small. In other words, according to the second embodiment, it is possible to provide the antenna apparatus 200 that is intended to be made small, as well as able to operate interchangeably as the folded dipole antenna or the slot antenna.

Therefore, by turning over the switches 271-274 in the antenna apparatus 200, it is possible to execute a diversity-based wireless communication with the folded dipole antenna and the slot antenna according to the second embodiment.

With the antenna apparatus 200 according to the second embodiment, it is possible to execute very preferable communications and to contribute to save space because it is small and has a low correlation between the two antennae (folded dipole antenna and slot antenna) for diversity.

Therefore, it is suitable for usage, for example, in configuring a wireless sensor network in which information is received that is to be detected by a node (wireless terminal). Here, the antenna apparatus 200 according to the second embodiment is very suitable for such usage as configuring a wireless sensor network or the like because it has a lower correlation between the two antennae (folded dipole antenna and slot antenna) for diversity than the antenna apparatus 100 according to the first embodiment.

Here, as for downsizing of the antenna apparatus 200, one of the contributing factors is to arrange the center position of the folded dipole antenna in the longitudinal direction coincident with the center position of the slot antenna in the longitudinal direction. However, these center positions do not necessarily need to be coincident with each other.

It is noted that, in the present embodiment, the folded dipole antenna is configured so that it has the other terminal 212B of the element 212 and the one terminal 214A of the element 214 as power feeding portions (first power feeding portions). The other terminal 212B of the element 212 and the one terminal 214A of the element 214 are at line-symmetric positions to each other across the Z-axis, positioned at the center of the folded dipole antenna in the longitudinal direction (X-axis direction).

However, the power feeding point of the folded dipole antenna may be disposed at an offset position from the center in the longitudinal direction shifted towards the X-axis positive direction or the X-axis negative direction. This may be implemented, for example, by shifting positions of the vias 251-252 without changing the forms of the elements 211-215, or by making the forms of the elements 211-215 non-symmetric across the X-axis.

Also, the power feeding portion (first power feeding portion) of the folded dipole antenna may be disposed at the antenna element 220. This will be described in the third embodiment.

Also in the present embodiment, although the power feeding portion (second power feeding portion) of the slot antenna is disposed at the element 211 of the antenna element 210 described, the power feeding portion (second power feeding portion) of the slot antenna may be disposed at any position in the X-axis direction.

Namely, the power feeding portion (second power feeding portion) of the slot antenna may be disposed at any position of the elements 211-215. This may be implemented, for example, by changing the position of the via 250.

Also, the power feeding portion (second power feeding portion) of the slot antenna may be disposed in the edge line 231 of the ground element 230 or in the vicinity of the edge line 231.

Also in the present embodiment, although a switch is not disposed between the power feeding portion (second power feeding portion) of the slot antenna and the RF module 260, a switch may be disposed between the power feeding portion (second power feeding portion) of the slot antenna and the RF module 260.

Also in the present embodiment, the length between the folded part 220B and the folded part 220D in the X-axis direction is shorter than the length between the folded part 211C of the element 211 and the folded part 215C of the element 215 in the X-axis direction.

However, by appropriately changing the forms of the antenna element 210 (elements 211-215) and the antenna element 220, the length between the folded part 220B and the folded part 220D in the X-axis direction may be set longer than the length between the folded part 211C of the element 211 and the folded part 215C of the element 215 in the X-axis direction. Also, the lengths may be set equivalent to each other.

Also in the present embodiment, the antenna element 210-220 and ground element 230 have the forms (patterns) as illustrated in FIG. 5.

However, as described above, the forms (patterns) of the antenna element 210-220 and ground element 230 are not limited to the ones described above, but may take other forms as long as the folded dipole antenna and the slot antenna have the same longitudinal direction, and the folded dipole antenna and the slot antenna are configured with shared parts in the direction.

Third Embodiment

Figure 12:
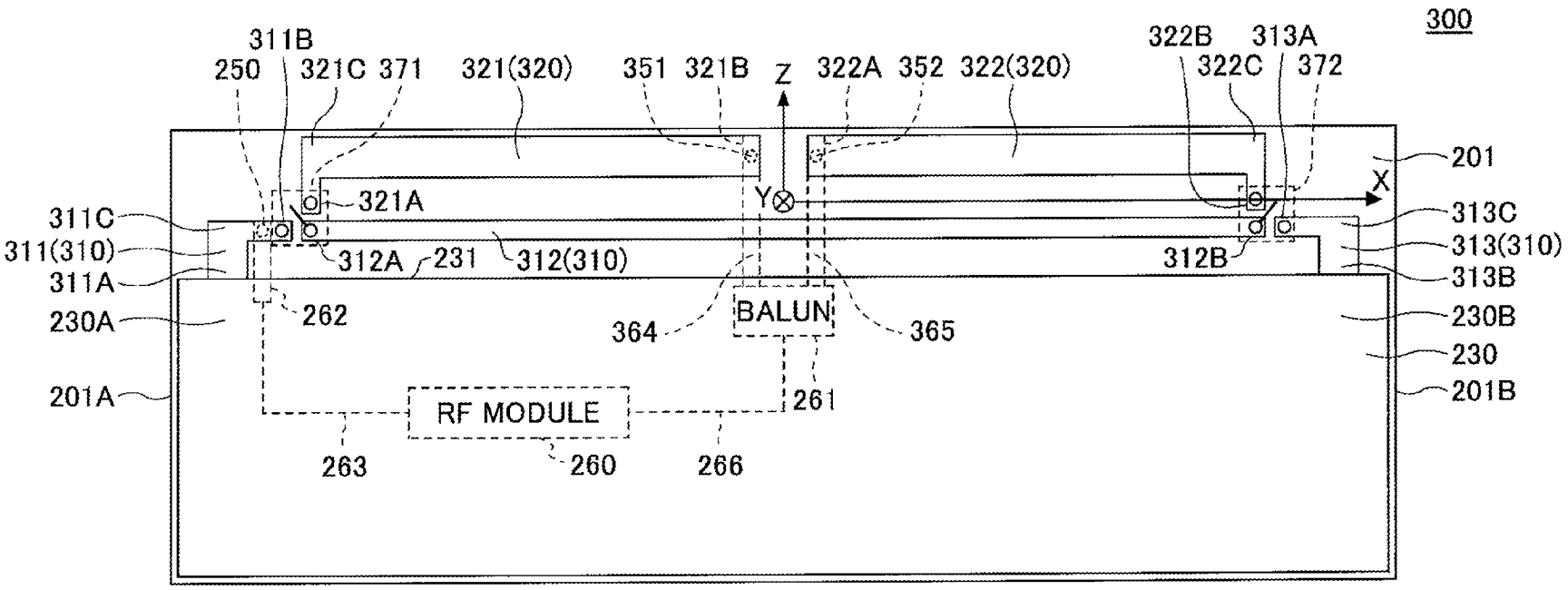
FIG. 12 is a schematic view illustrating an antenna apparatus 300 according to a third embodiment.

FIG. 12 is a schematic view illustrating an antenna apparatus 300 according to the third embodiment.

According to the third embodiment, the antenna apparatus 300 has the power feeding portion (first power feeding portion) of the folded dipole antenna in the antenna apparatus 200 according to the second embodiment disposed at the side of the antenna element 220.

In the following, differences from the antenna apparatus 200 according to the second embodiment will be mainly described. Also, substantially the same configuration elements as those in the antenna apparatus 200 according to the second embodiment are assigned the same numerical codes, and their description may be omitted.

The antenna apparatus 300 includes a circuit board 201, antenna elements 310-320, a ground element 230, and switches 371-372 according to the third embodiment.

The antenna element 310 includes elements 311-313.

The antenna element 310 (elements 311-313) and the antenna element 320 are used to configure a slot antenna and a folded dipole antenna, to which a connection is turned over by switches, which will be described later.

The slot antenna is configured with the elements 311-313 of the antenna element 310 and ground element 230. Also, the folded dipole antenna is configured with the element 312 of the antenna element 310 and antenna element 320.

Here, a configuration of the antenna element 310 will be described. As described above, the antenna element 310 includes the elements 311-313. The antenna element 310 is an example of the first element.

The element 311 is a conductor with an L-shape form in plane view, and substantially the same as the element 211 of the antenna apparatus 200 according to the second embodiment. The element 311 has one terminal 311A connected with the corner part 230A of the ground element 230 and another terminal 311B is disposed in the vicinity of one terminal 312A of the element 312 in the X-axis negative region. The element 311 is folded at a folded part 311C positioned between the one terminal 311A and the other terminal 311B.

Also, a via 250 is connected with the element 311 at a bit more negative position in the X-axis than the other terminal 311B (closer to the one terminal 311A) for feeding power to the antenna element 310. The point where the element 311 is connected with the via 250 is an example of the second power feeding portion.

The one terminal 312A of the element 312 is disposed in the vicinity of the other terminal 311B at X-axis positive direction of the element 311, and another terminal 312B is disposed in the vicinity of one terminal 313A of the element 313.

The element 312 is a line-shaped conductor extending along the X-axis. The element 312 has a configuration in which the elements 212, 213, and 214 according to the second embodiment are united. Therefore, the position of the one terminal 312A of the element 312 is the same as the position of the one terminal 212A of the element 212 (see FIG. 5) according to the second embodiment. Also, the position of the other terminal 312B of the element 312 is the same as the other terminal 214B of the element 214 (see FIG. 5) according to the second embodiment.

The one terminal 313A of the element 313 is disposed in the vicinity of the other terminal 312B of the element 312 in the X-axis positive direction, and another terminal 313B is connected with the corner part 230B of the ground element 230. The element 313 is an L-shaped conductor, and disposed at the line-symmetric position with the element 311 across the Z-axis. Namely, the element 313 is substantially the same as the element 215 according to the second embodiment (see FIG. 5).

The element 313 is folded at a folded part 313C positioned between the one terminal 313A and the other terminal 313B. Here, the element 313 is not provided with a power feeding portion, which is different from the element 311.

In the antenna element 310 described above, the length between the folded part 311C of the element 311 and the folded part 313C in the X-axis direction is set to half of the wavelength (λ) of the operational frequency of the antenna apparatus 300 according to the third embodiment.

The antenna element 320 includes elements 321-322. The antenna element 320 has a form that is obtained by dividing the form of the antenna element 220 according to the second embodiment (see FIG. 5) at the center in the X-axis direction into two parts (into the elements 321-322).

The antenna element 320 is an example of the second element, which is disposed along the antenna element 310 on the opposite side of the ground element 230 relative to the antenna element 310 in plane view.

The element 321 is an L-shaped conductor that extends a bit from the one terminal 321A in the Z-axis positive direction, turns by 90 degrees in the X-axis positive direction at the folded part 321C, and reaches the other terminal 321B. The other terminal 321B is positioned closer in the X-axis negative direction than the Z-axis, in the vicinity of the one terminal 322A of the element 322 in the X-axis negative direction.

The one terminal 322A of the element 322 is positioned in the vicinity of the other terminal 321B of the element 321 in the X-axis positive direction. The element 322 is an L-shaped conductor that extends from the one terminal 322A in the X-axis positive direction, turns by 90 degrees in the Z-axis negative direction at the folded part 322C, and reaches the other terminal 322B.

The elements 321-322 have line-symmetric forms (patterns) with each other across the Z-axis.

In the antenna element 320 described above, the length between the folded part 321C of the element 321 and the folded part 322C in the X-axis direction is set to half of the wavelength (λ) of the operational frequency of the antenna apparatus 300 according to the third embodiment.

In the antenna apparatus 300 according to the third embodiment, the other terminal 321B of the element 321 and the one terminal 322A of the element 322 are connected to the balun 261 via wiring parts 364-365 disposed on the back of the circuit board 201 and vias 351-352, respectively.

The wiring parts 364-365 and the vias 351-352 correspond to the pads 264-265 and the vias 251-252 according to the second embodiment (see FIG. 5), respectively, that are moved in the Z-axis positive direction to be connected with the elements 321-322 of the antenna element 320.

Namely, in the antenna apparatus 300 according to the third embodiment, the other terminal 321B of the element 321 of the antenna element 320 and the one terminal 322A of the element 322 are the first power feeding portions.

Here, the antenna apparatus 300 according to the third embodiment does not include pads that correspond to the pads 241-242 in the antenna apparatus 200 according to the second embodiment.

The antenna apparatus 300 includes two switches 371-372 according to the third embodiment. For the switches 371-372, similarly to the switches 271-274 according to the second embodiment, for example, SPDT switches may be used. The switches 371-372 are examples of the connecting parts.

The switch 371 connects the one terminal 312A of the element 312 with one of the other terminal 311B of the element 311 and the one terminal 321A of the element 321.

The switch 372 connects the other terminal 312B of the element 312 with one of the one terminal 313A of the element 313 and the other terminal 322B of the element 322.

When configuring the folded dipole antenna, the switch 371 connects the one terminal 312A of the element 312 with the one terminal 321A of the antenna element 321. Also, the switch 372 connects the other terminal 312B of the element 312 with the other terminal 322B of the element 322.

In this way, the folded dipole antenna is configured to include the element 312 of the antenna element 310 and the elements 321-322 of the antenna element 320, and has the other terminal 321B of the element 321 and the one terminal 322A of the element 322 as power feeding portions (first power feeding portions). The other terminal 321B and the one terminal 322A are fed with power from the RF module 260 through the vias 351-352, wiring parts 364-365, balun 261, and coaxial cable 266, respectively.

The folded dipole antenna is configured by connecting the first terminal part (the one terminal 312A of the element 312) and the second terminal part (the other terminal 312B of the element 312) of the antenna element 310 as an example of the first element, with the first terminal part (the one terminal 321A of the element 321) and the second terminal part (the other terminal 322C of the element 322) of the antenna element 320 as an example of the second element, respectively.

Also, the folded dipole antenna is fed with power by supplying high-frequency signals in reversed phases to each other to the elements 321-322 from the RF module 260 through the vias 351-352, wiring parts 364-365, balun 261, and coaxial cable 266.

The folded dipole antenna has its polarization directed for the horizontally polarized wave (X-axis direction) to obtain a polarized wave in the direction parallel to the longitudinal direction of the folded dipole antenna. The longitudinal direction of the folded dipole antenna is in the X-axis direction. In other words, the longitudinal direction of the folded dipole antenna is the direction coming from the folded part 321C of the element 321 towards the folded part 322C of the element 322, or the direction opposite to it. Also, the longitudinal direction of the folded dipole antenna is the direction in which the element 312 of the antenna element 310 extends.

Also, when configuring the slot antenna, the switch 371 connects the one terminal 312A of the element 312 with the other terminal 211B of the element 311. Also, the switch 372 connects the other terminal 312B of the element 312 with the one terminal 313A of the element 313.

In this way, the slot antenna is configured to include the elements 311-313 of the antenna element 310 and a part of the ground element 230 on the side of the edge line 231, and is fed with power through the via 250.

The slot antenna is configured by connecting the first terminal part (the one terminal 311A of the element 311) and the second terminal part (the other terminal 313B of the element 313) of the antenna element 310 as an example of the first element, with the ground element 230 as an example of the ground plate.

Also, the slot antenna is fed with power by supplying high-frequency signals to the antenna element 310 from the RF module 260 through the via 250, pad 262, and coaxial cable 263. The antenna element 310 of the slot antenna and a part of the ground element 230 on the side of the edge line 231 are supplied with high-frequency signals in reversed phases to each other from the RF module 260 because the shielding wire of the coaxial cable 263 is connected with the ground element 230.

The slot antenna has its polarization directed for the vertically polarized wave (Z-axis direction) to obtain a polarized wave in the direction orthogonal to the longitudinal direction of the slot antenna. In other words, with the slot antenna, a polarization is generated in the direction between a part (a part extending in the X-axis direction) of the antenna element 310 mainly around the elements 311, 312, and 313, and the edge line 231 of the ground element 230.

As above, in the antenna apparatus 300 according to the third embodiment, the polarization direction (horizontal polarized wave) obtained by the folded dipole antenna configured with the antenna elements 310-320 and ground element 230 differs from the polarization direction (vertical polarized wave) obtained with the slot antenna by 90 degrees.

As above, the folded dipole antenna and the slot antenna implemented in the antenna apparatus 300 share the antenna element 310 (at least the element 312) according to the third embodiment.

Namely, according to the third embodiment, the antenna apparatus 300 is obtained by sharing parts between the folded dipole antenna that has its longitudinal direction in the X-axis direction and the slot antenna that also has its longitudinal direction in the X-axis direction, and placing them adjacent to each other in the Z-axis direction.

In other words, the antenna apparatus 300 is obtained by combining (or uniting) parts of the folded dipole antenna that has its longitudinal direction in the X-axis direction and the slot antenna that also has its longitudinal direction in the X-axis direction, and placing them adjacent to each other in the Z-axis direction.

Thus, the antenna apparatus 300 may be made small and may have the folded dipole antenna and the slot antenna interchangeably implemented.

Therefore, according to the third embodiment, it is possible to provide the antenna apparatus 300 that is intended to be made small. In other words, according to the third embodiment, it is possible to provide the antenna apparatus 300 that is intended to be made small, as well as able to operate interchangeably as the folded dipole antenna or the slot antenna.

Therefore, by turning over the switches 371-372 in the antenna apparatus 300, it is possible to execute diversity-based wireless communications with the folded dipole antenna and the slot antenna according to the second embodiment.

As above, the folded dipole antenna and the slot antenna included in the antenna apparatus 300 according to the third embodiment are similar to the folded dipole antenna and the slot antenna included in the antenna apparatus 200 according to the second embodiment.

Therefore, the folded dipole antenna and the slot antenna included in the antenna apparatus 300 according to the third embodiment have a low correlation and favorable communication characteristics.

With the antenna apparatus 300 according to the third embodiment, it is possible to execute very preferable communications and to contribute to saving space because it is small and has a low correlation between the two antennae (folded dipole antenna and slot antenna) for diversity.

Therefore, it is suitable for usage, for example, in configuring a wireless sensor network in which information is received that is to be detected by a node (wireless terminal). Here, the antenna apparatus 300 according to the third embodiment is very suitable for such usage in configuring a wireless sensor network or the like because it has a lower correlation between the two antennae (folded dipole antenna and slot antenna) for diversity than the antenna apparatus 100 according to the first embodiment.

Here, various modifications can be applied to the antenna apparatus 300 according to the third embodiment similarly to the antenna apparatus 200 according to the second embodiment.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An antenna apparatus comprising:

a ground plate configured to have an edge line;

a first antenna element disposed along the edge line of the ground plate, the first antenna element having a first element and a second element, the first element having a first terminal part and a second terminal part, the second element having a third terminal part and a fourth terminal part, the first terminal part and the fourth terminal part being placed at both ends of the first antenna element, the second terminal part being placed adjacent to the third terminal part;

a second antenna element disposed along the first antenna element, the second antenna element positioned on an opposite side of the ground plate with respect to the first antenna element positioned between the second antenna element and the ground plate in plan view, the second antenna element having a fifth terminal part and a sixth terminal part;

a first switch configured to connect the first terminal part of the first antenna element with one of the fifth terminal part of the second antenna element and the ground plate;

a second switch configured to connect the fourth terminal part of the second element with one of the sixth terminal part of the second antenna element and the ground plate;

a third switch configured to connect the second terminal part with one of the third terminal part and a first feeding line;

a fourth switch configured to connect the third terminal part with one of the second terminal part and a second feeding line;

two first power feeding portions configured to feed power at the second terminal part and the third terminal part, respectively, when the first terminal part and the fifth terminal part are connected with each other by the first switch, the fourth terminal part and the sixth terminal part are connected with each other by the second switch, the second terminal part and the first feeding line are connected with each other by the third switch, and the third terminal part and the second feeding line are connected with each other by the fourth switch; and a second power feeding portion configured to feed power to the first antenna element or the ground plate when the first terminal part and the ground plate are connected with each other by the first switch, the fourth terminal part and the ground plate are connected with each other by the second switch, the second terminal part and the third terminal part are connected with each other by the third switch and the fourth switch.

2. The antenna apparatus as claimed in claim 1, wherein the first antenna element and the second antenna element connected by the first switch and the second switch constitute a folded dipole antenna, and the first antenna element and the ground plate connected by the first switch and the second switch constitute a slot antenna.

3. The antenna apparatus as claimed in claim 2, wherein the folded dipole antenna and the slot antenna share the first antenna element.

4. The antenna apparatus as claimed in claim 2, wherein a center in the longitudinal direction of the folded dipole antenna coincides with a center in the longitudinal direction of the slot antenna.

5. The antenna apparatus as claimed in claim 1, further comprising:

a controller configured to control a connection state of the first switch and the second switch.

6. The antenna apparatus as claimed in claim 1, wherein the first switch and the second switch are three-terminal switches.

7. An antenna apparatus comprising:

a ground plate configured to have an edge line;

a first antenna element disposed along the edge line of the ground plate, the first antenna element having a first element and a second element, the first element having a first terminal part and a second terminal part, the second element having a third terminal part and a fourth terminal part, the first terminal part and the fourth terminal part being placed at both ends of the first antenna element, the second terminal part being placed adjacent to the third terminal part;

a second antenna element disposed along the first antenna element, the second antenna element positioned on an opposite side of the ground plate with respect to the first antenna element positioned between the second antenna element and the ground plate in plan view, the second antenna element having a fifth terminal part and a sixth terminal part;

a first switch configured to connect the first terminal part of the first antenna element with one of the ground plate and the fifth terminal part of the second antenna element; and a second switch configured to connect the fourth terminal part of the second element with one of the sixth terminal part of the second antenna element and the ground plate;

wherein the first antenna element and the ground plate connected by the first switch and the second switch constitute a slot antenna, and the first antenna element and the second antenna element connected by the first switch and the second switch constitute a folded dipole antenna.

8. An antenna apparatus comprising:

a ground plate configured to have an edge line;

a first antenna element disposed along the edge line of the ground plate, the first antenna element having a first terminal part and a second terminal part, the first terminal part and the second terminal part being placed at both ends of the first antenna element;

a second antenna element disposed along the first antenna element, the second antenna element positioned on an opposite side of the ground plate with respect to the first antenna element positioned between the second antenna element and the ground plate in plan view, the second antenna having a first element and a second element, the first element having a third terminal part and a fourth terminal part, the second element having a fifth terminal part and a sixth terminal part, the third terminal part and the sixth terminal part being placed at both ends of the second antenna element, the fourth terminal part being placed adjacent to the fifth terminal part;

a first switch configured to connect the first terminal part of the first antenna element with one of the third terminal part of the second antenna element and the ground plate;

a second switch configured to connect the second terminal part of the first antenna element with one of the sixth terminal part of the second antenna element and the ground plate;

two first power feeding portions configured to feed power at the fourth terminal part and the fifth terminal part, respectively, when the first terminal part and the third terminal part are connected with each other by the first switch and the second terminal part and the sixth terminal part are connected with each other by the second switch; and a second power feeding portion configured to feed power to the first antenna element or the ground plate when the first terminal part and the ground plate are connected with each other by the first switch and the second terminal part and the ground plate are connected with each other by the second switch.

* * * * *